United States Patent [19]

Jaisinghani et al.

[11] Patent Number: 4,853,005

[45] Date of Patent: Aug. 1, 1989

[54] ELECTRICALLY STIMULATED FILTER METHOD AND APPARATUS

[75] Inventors: Rajan A. Jaisinghani, Midlothian; Thomas A. Hamade, Richmond, both of Va.; Clyde W. Hawley, Fairport, N.Y.

[73] Assignee: American Filtrona Corporation, Richmond, Va.

[21] Appl. No.: 48,452

[22] Filed: May 11, 1987

Related U.S. Application Data

[63] Continuation of Ser. No. 785,757, Oct. 9, 1985, abandoned.

[51] Int. Cl.[4] ..... B03C 3/00

[52] U.S. Cl. ..... 55/132; 55/138; 55/151; 55/146; 55/148

[58] Field of Search ..... 55/131, 2, 132, 6, 155, 55/138, 146, 147, 148, 150, 151

[56] References Cited

U.S. PATENT DOCUMENTS

| | | | |
|---|---|---|---|
| 2,297,601 | 9/1942 | Williams | 55/132 |
| 2,973,054 | 2/1961 | Kurtz | 183/7 |
| 3,108,865 | 10/1963 | Berly | 55/131 |
| 3,242,649 | 3/1966 | Rivers | 55/132 |
| 3,537,238 | 11/1970 | Dungter | 55/131 |
| 3,997,304 | 12/1976 | Carr | 55/147 |
| 4,007,024 | 2/1977 | Sallee et al. | 55/126 |
| 4,205,969 | 6/1980 | Matsumoto | 55/131 |
| 4,244,710 | 1/1981 | Burger | 55/6 |
| 4,279,625 | 7/1981 | Inculet | 55/131 |
| 4,313,739 | 2/1982 | Douglas-Hamilton | 55/2 |
| 4,357,150 | 11/1982 | Masuda et al. | 55/6 |
| 4,509,958 | 4/1985 | Masuda | 55/132 |

FOREIGN PATENT DOCUMENTS

| | | | |
|---|---|---|---|
| 821315 | 8/1969 | Canada . | |
| 821900 | 9/1969 | Canada . | |
| 892908 | 9/1969 | Canada | 183/708 |
| 2532727 | 2/1976 | Fed. Rep. of Germany . | |
| 52-37273 | 9/1975 | Japan | 46/52 |
| 2160477 | 12/1985 | United Kingdom . | |

OTHER PUBLICATIONS

W. Bergman et al., "Electric Air Filtration: Theory, Laboratory Studies, Hardware Development, and Field Evaluations", Lawrence Livermore National Laboratory, UCID-19952, Jan. 9, 1984, pp. 99-107, 168.

"Effect of Relative Humidity and Particulate Electrical Properties on ESF Performance", 8/9/85, Jaisinghani and Hamade.

*Primary Examiner*—Bernard Nozick

*Attorney, Agent, or Firm*—Holman & Stern

[57] ABSTRACT

An electrically stimuated filter assembly includes a filter unit in which an air gap is maintained between the filter medium and electrodes disposed on opposite sides of that medium, thereby preventing degradation of filter efficiency by humid filtered fluid. The filter medium is a sheet-like member folded in multiple accordion pleats and disposed between two plate electrodes, one of which is grounded to the chassis, the other of which is at high voltage. The air gaps are established by insulative plastic combs having bases secured to the electrode plates and teeth projecting from the bases into troughs of the folded filter. The high voltage plate is on the downstream side of the filter and mounted recessed from the downstream opening by insulative tubes secured to both the filter housing and the high voltage plate. A precharger is disposed in the assembly upstream of the filter unit and includes plural individual high voltage wires suspended in mutually spaced parallel relation across the flow path. The precharger is housed in a grounded metal frame which is insulated from the wires.

24 Claims, 5 Drawing Sheets

ELECTRICALLY STIMULATED FILTER METHOD AND APPARATUS

This is a continuation of application Ser. No. 785,757, filed Oct. 09, 1985 now abandoned.

BACKGROUND OF THE INVENTION

1. Technical Field

The present invention relates to electrically stimulated filters which operate to remove particles, such as dust, from a fluid, such as air. More particularly, the invention relates to improved filtering and precharging in an electrically stimulated filter assembly.

2. Discussion of the Prior Art

Electrically stimulated filters are well known in the prior art. Examples of such filters may be found in the following: U.S. Pat. Nos. 2,973,054 (Kurtz); 3,242,649 (Rivers), 3,997,304 (Carr), 4,244,710 (Burger), 4,279,625 (Inculet, et al.), 4,313,739 (Douglas-Hamilton), 4,357,150 (Masuda, et al.) and 4,509,958 (Masuda, et al.); Canadian Patent Nos. 821,315 (Inculet) and 821,900 (Incultet, et al.); British Patent No. 892,908; Japanese Patent No. 52,37273; and German Patent Publication 25 32 727. Typically, in the filtering section of the filter assembly, prior art electrically stimulated filters employ electrodes which are in direct contact with the filter medium. This is best illustrated in the Masuda, et al., patents. The filter medium employed is electrically non-conductive and is typically a material such as fiberglass. The amount of current drawn by such electrically stimulated filters is reasonable when the gas to be filtered is at a low relative humidity. However, as the relative humidity of the gas increases, the high voltage current increases exponentially as illustrated by curve A in FIG. 13 of the accompany drawings. The ultimate result is either a drop in voltage across the filter unit or a total shut-off of the power applied to the unit. In either case the efficiency of the filter is drastically reduced. The result is unreliable filtering which is the main reason that electrically stimulated filter technology has not gained wide commercial acceptability.

Another problem area contributing to the lack of commercial acceptability of prior art electrically stimulated filters relates to the precharger. Prechargers are employed to electrically charge suspended particles in the gas, prior to the filtering stage, so that the charged particles may be more readily separated. A commonly employed prior art precharger, as disclosed in the above-mentioned Masuda, et al., patents, includes multiple grounded parallel plates with corona wires strung between them. This precharger design results in a high probability of error in achieving wires equispaced from grounded plates. If the wires are not equispaced from the grounded plates, current leaks through a local point resulting in severe reduction in ionization and, thereby, inefficient charging of the suspended particles by the precharger.

OBJECTS AND SUMMARY OF THE INVENTION

It is therefore an object of the present invention to provide an electrically stimulated filter in which the filter efficiency is only minimally, if at all, affected by increases in humidity in the fluid medium being filtered.

It is another object of the present invention to provide an improved precharger for an electrically stimulated filter in which equispacing from corona wires to the grounded plates is more readily achieved than in prior art precharger units.

It is a further object of the present invention to provide an improved electrically stimulated filter assembly in which the aforementioned limitations and disadvantages of the prior art are substantially eliminated.

In accordance with the present invention the problem of reduced filtering efficiency in the presence of high relative humidity is eliminated by separating the electrodes from the filter material by respective air gaps. The air gaps, nominally one-eighth inch in length, permit the current to increase only marginally for relative humidities of up to 100%. In addition, the downstream high voltage electrode employed in the filter is mounted slightly recessed from the downstream end of the filter and electrically isolated from the frame so as to permit the use of a metal frame, thereby reducing labor and material costs.

In order to achieve equispacing in an inexpensively manufactured precharger, the precharger is provided in a metal housing frame having grounded perforated plates at its front and back ends and through which the fluid stream to be filtered is caused to flow.

Two metal angle beams are suspended on opposite sides of the flow path by ceramic insulators fastened to the metal frame. The corona wires are suspended between the opposed angle beams. The ceramic insulators prevent sparking and current loss from the angle bar to the metal frame of the precharger. The corona wires are suspended by means of springs secured at the ends of the wires to the angle beam. Since the angle bar and the springs have larger dimensions than the corona wires, the angle bars and springs are somewhat closer to the perforated grounded plates at the ends of the housing and can, therefore, be a cause for creating a non-uniform field. In order to circumvent this, these components are shielded by U-shaped covers of plastic insulating material.

BRIEF DESCRIPTION OF THE DRAWINGS

These and other objects and advantages of the present invention will become more apparent from the following detailed description and appended claims considered in conjunction with the accompanying drawings wherein like reference numerals are used to designate common elements in the various figures, and wherein:

DESCRIPTION OF THE PREFERRED EMBODIMENTS

Figure 2:
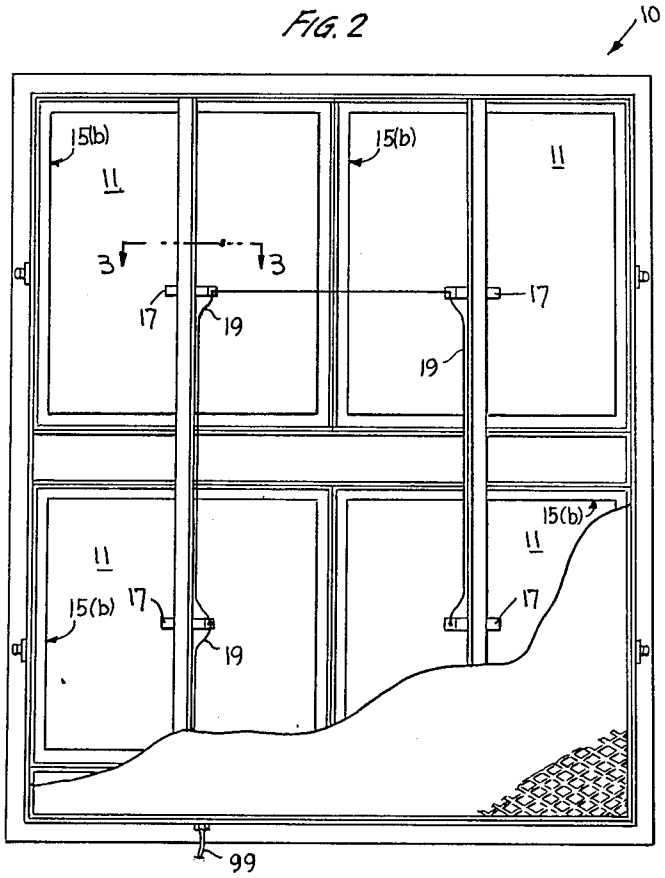
FIG. 2 is a front view in elevation of the assembly of FIG. 1.
Figure 1:
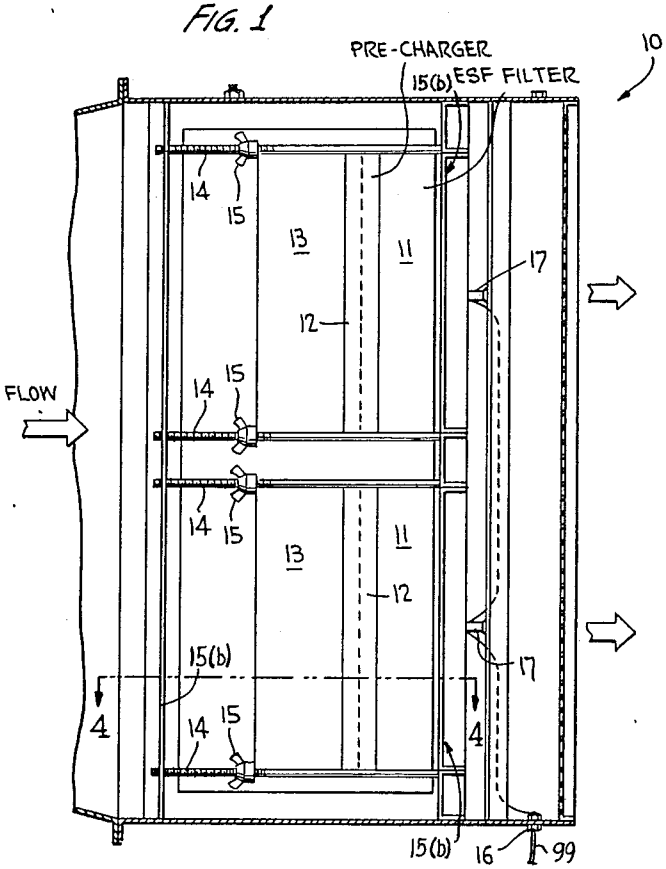
FIG. 1 is a side view in elevation of a filter assembly constructed in accordance with the present invention.
Figure 3:
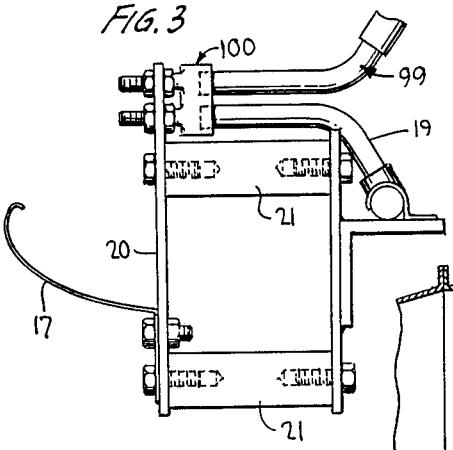
FIG. 3 is a view taken along lines 3—3 of FIG. 2.
Figure 4:
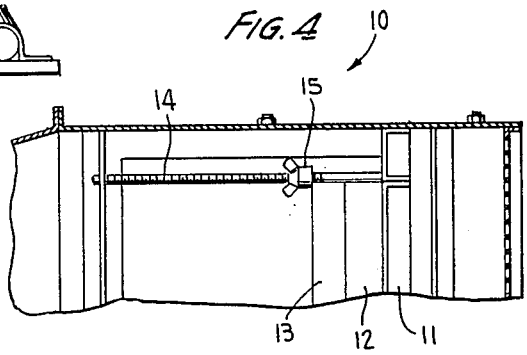
FIG. 4 is a detailed side view of a portion of the assembly of FIG. 1.
Figure 5:
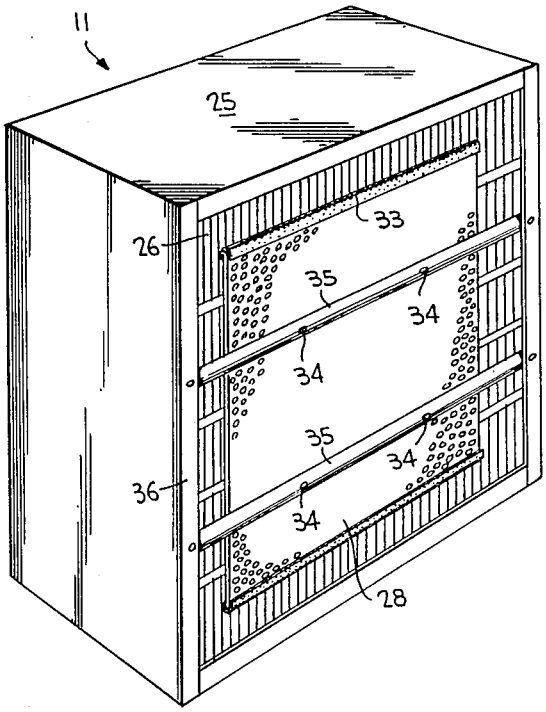
FIG. 5 is a view in perspective of the electrically stimulated filter unit employed in the assembly of FIG. 1.
Figure 6:
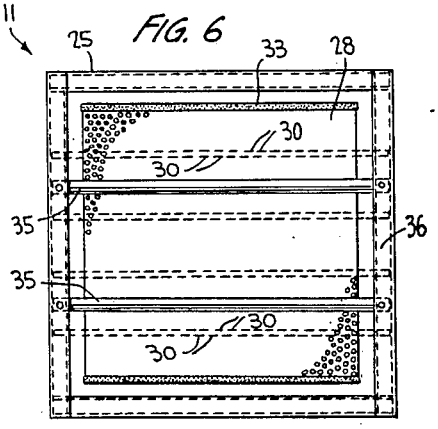
FIG. 6 is a front view in elevation of the electrically stimulated filter unit of FIG. 5.
Figure 7:
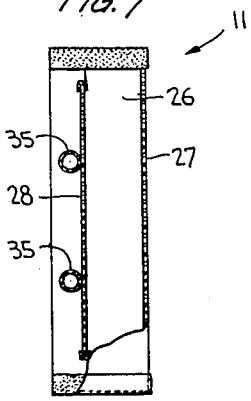
FIG. 7 is a side view in elevation, partially broken, of the electrically stimulated filter unit of FIG. 5.
Figure 8:
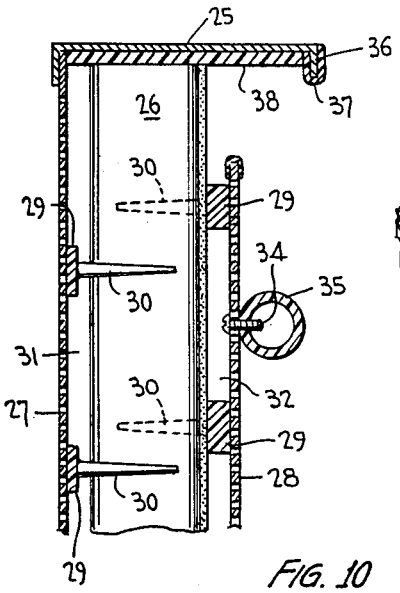
FIG. 8 is a partial view in vertical section of the electrically stimulated filter unit of FIG. 5.
Figure 9:
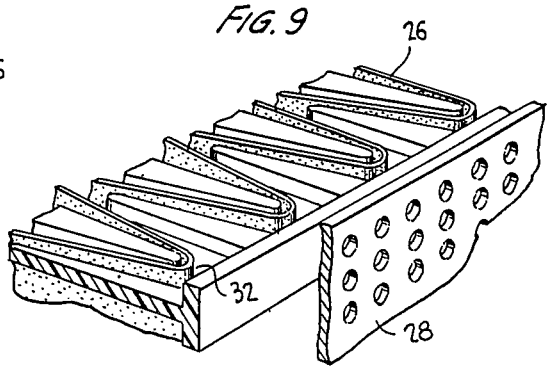
FIG. 9 is a view in perspective of a portion of the filter unit of FIG. 8.

Referring specifically to FIGS. 1 through 4 of the accompanying drawings, the filter and precharger units of the present invention may be employed in an overall filter assembly 10 which includes four electrically stimulated filters 11 and four precharger units 12. Four metal non-electrified pre-filter units 13 are employed, each with a respective combination of an precharger 12 and electrically stimulated filter 11, and are also disposed in the housing for assembly 10. Each combination of an electrically stimulated filter 11, precharger 12 and pre-filter 13 is disposed in a respective quadrant of the housing for assembly 10 to provide four respective parallel flow paths through the assembly for the fluid medium to be filtered. In this regard, flow is directed so as to first pass through the pre-filter 13, then through the precharger 12 and finally through the electrically stimulated filter 11 before egressing from assembly 10. Since the individual housing for elements 11, 12 and 13 are metal, all of these housings are at the same potential. This potential is a ground potential established by the metal housing for assembly 10. The downstream side of the electrically stimulated filter unit 11 seals against the frame of the housing for assembly 10 while the precharger unit 12 seals against the electrically stimulated filter panel on its upstream side. Similarly, the pre-filter 13 seals against the precharger 12. Each of the four sub-units is inserted through the service doors of the assembly housing and is placed over the threaded rods 14 and wing nuts 15 which are fastened between the metal frames 15*a* and 15*b*. The sub-units are then tightened in place by tightening the wing nuts 15 so that the filter unit 11 seals against the frame 15(*b*) of assembly 10 and the pre-charger 12, seals against filter unit 11, and the pre-filter 13 seals against the pre-charger 12. Note that for each of the four sub-units there are four threaded rods 14, and four wing nuts 15. This enables each sub-unit to be secured against the frame of assembly 10 as shown in FIG. 1. A single high voltage cable 99 from the external high voltage power supply is brought into the assembly 10 through an orifice with a grommet 16 (or other well-known sealing means) such that the space between the cable and the orifice is sealed by the grommet 16 and an adhesive as is conventional. This cable 99 is directly connected to metal strip 20 in any one of the four connector assemblies 100 shown in FIG. 3. The remaining three connector assemblies are powered by running cable 19 from the powered connector assembly 100 to another connector assembly and so on (as shown in FIG. 2) until all four connector assemblies are powered. This distribution of the high voltage power is then provided at the downstream sides of the electrically stimulated filters via connectors 17. These connectors 17 are spring members which serve as connection points between the high voltage wiring and the hot or high voltage electrodes of the electrically stimulated filters. This technique, as best illustrated in FIG. 3, eliminates the need for expensive wiring and connectors. The high voltage cable 19 is run from the various connectors to the metal plates 20 upon which the spring connectors 17 are mounted. Appropriate ceramic insulators 21 are utilized as necessary to support the spring assembly on the housing 10 and cable as it is run from sub-unit to sub-unit.

Referring specifically to FIGS. 5–9 of the accompanying drawings, each electrically stimulated filter unit 11 includes a metal square or rectangular frame 25 having upstream and downstream ends. A filter medium 26 is disposed within the frame 25 and takes the form of a sheet of material having multiple accordion pleats extending transversely of the direction of flow through the frame 25. For purposes of reference, the dimension of the fold lines for the filter medium will be described as lengthwise, whereby the orthogonal dimension, also transverse to the direction of flow, will be described as widthwise. The material for medium 26 is a non-conductive filter medium normally used for the purpose of particulate filtering from gaseous medium. A commonly employed material for this purpose is fiberglass, although other materials may be employed. The accordion pleats are provided to increase the surface area of the filter medium to which the flowing fluid is exposed. Typically, the pleats are approximately four inches to six inches in depth.

The upstream end of the filter unit is covered with a perforated metal plate 27 serving as the ground or a low voltage electrode. Electrode plate 27 is grounded by virtue of its contact with the frame portion 25 of the housing. The high voltage electrode is disposed proximate, but slightly recessed from, the downstream end of the filter assembly and comprises a perforated plate 28 mounted in a manner described in greater detail hereinbelow.

The pleated or convoluted filter medium 26 utilizes insulative plastic comb-like spacer members to maintain the pleat spacing and also to maintain an air gap between the filter medium 26 and each of the electrodes 27 and 28. More specifically, each spacer member includes a base portion 29 from which a multiplicity of teeth 30 project in parallel spaced relation. The base portion 29 is secured against the inside surface of a corresponding perforated electrode plate 27, 28. The base portion 29 blocks only an insignificantly small fraction of the area of the plate so that no meaningful interference with air flow through the plate is produced. The teeth 30 project into respective troughs of the pleated filter medium 26 to thereby maintain the spacing between adjacent pleats. Since the teeth project from both electrodes into the pleats, the pleating is maintained integral from both sides of the filter medium. More importantly, a key function provided by the insulative spacers 29, 30, is the provision of air gaps 31 and 32. Air gap 31 is disposed between the grounded perforated electrode plate 27 and the filter medium 26; air gap 32 is provided between the high voltage perforated electrode plate 28 and the filter medium 26. These air gaps make it possible to operate the electrostatic filter, at high humidities.

The high voltage perforated electrode plate 28 is smaller on each of its length and width dimensions than the downstream opening in the housing 25 of filter unit 11. Typically, plate 28 is shorter than the frame by three to six inches at each dimension so as to achieve a border of one and a half to three inches of free space around the electrode plate. A plastic jacket 33 is slipped around the edges of the electrode plate 28 so as to further insulate the plate from the frame 25. The electrode plate is mounted via a pair of screws 34 to respective insulating pipes 35, there being two such pipes employed in the preferred embodiment. These plastic pipes, which may be made of polyvinyl chloride (PVC) are typically three-quarter inch in outside diameter and are secured to the downstream-facing surface of the high voltage electrode plate 28. The pipes are then oriented with their lengths extending widthwise of frame 25 and their ends are secured to the upstream-facing surface of a lip 36 extending from the frame a short distance into the flow path at the downstream end of frame 25. For this purpose, pipes 35 are longer than the electrode plate 28 and are sufficiently long to permit them to be secured, by screws, or the like, to the lip 36. Lip 36 is covered with a plastic material for purposes of insulation.

It is to be noted that the depth of frame 25 (i.e., the dimension in the flow direction) is larger than the depth of the pleats in the filter medium 26. This permits the pipes 35 to be accommodated within the frame. It is to be noted that the screws utilized to secure the pipes 35 to the lip 36 of frame 25 are offset from the screws which secure the electrode plate 28 to the pipes 35. There must be at least a three inch gap between these sets of screws in order to avoid any possibility of sparking. It should also be noted that the plastic tubes 35 can be secured to the plate 28 and to the lip 36 by means of an adhesive material.

The air gaps 31 and 32, which are a crucial part of the present invention, are approximately one-eighth inch in length (i.e., the dimension between the filter medium and the electrode). This spacing is maintained, in the preferred embodiment, by the comb-like structure of the spacers including base 29 and the tapered teeth 30. More particularly, the teeth 30 are closer together at their root ends than at their tip ends so that the pleats of the filter medium 26 can be inserted only to a limited depth between the teeth 30. This, plus the depth of the base member 29, establishes the length of the air gap. It should be noted that the particular means for providing the air gap, namely the comb-like members, is the preferred means for achieving the air gap; however, other methods of achieving the air gap spacing may be employed within the scope of the present invention. The important point is that an air gap can be provided between the filter medium and the electrodes.

In the preferred embodiment eight comb-like members are used with each electrically stimulated filter unit 11, there being four spacers secured to each electrode plate.

The lip 36 of the metal frame 25 is covered with an insulating plastic material 37 so that no bare metal surfaces are exposed. A high electrical resistivity insulating hot melt plastic 38, or other adhesive, is poured into the frame 25, on the side of the high voltage electrode 28 in order to seal the filter medium 26 to the frame 25 and thereby prevent bypass of air around the edges of the filter medium. This plastic material 38 also ensures at least one-eighth to one-quarter inch thickness of insulating hot melt to cover all metal surfaces inside the metal frame 25 on the high voltage side of the filter medium 26. As a result, any possibility of spark discharge from the high voltage electrode to the ground metal frame is eliminated. The plastic material 37 disposed over lip 36 may be a urethane gasket and is contoured to seal against a bordering frame in the housing for assembly 10.

Figure 10:
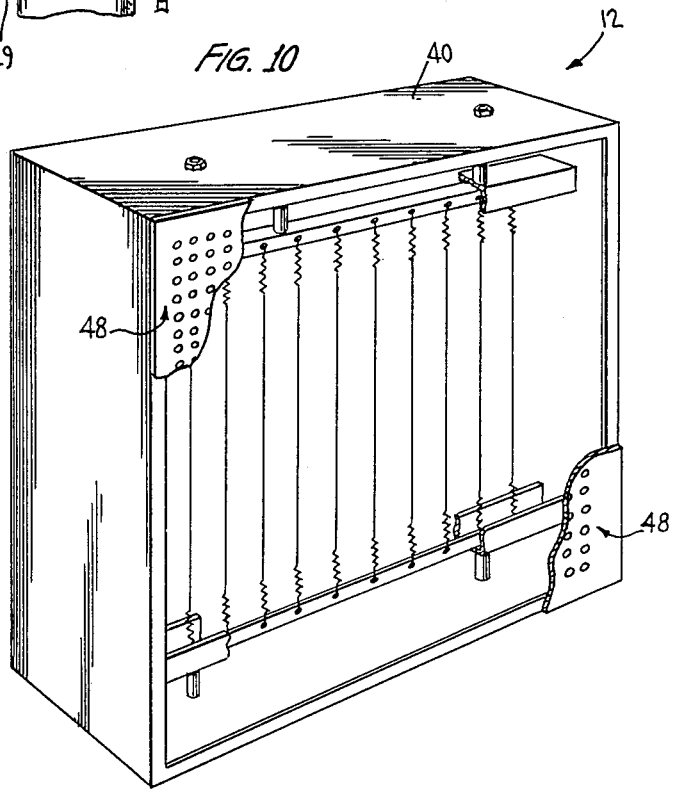
FIG. 10 is a view in perspective of the pre-charger unit employed in the assembly of FIG. 1.
Figure 11:
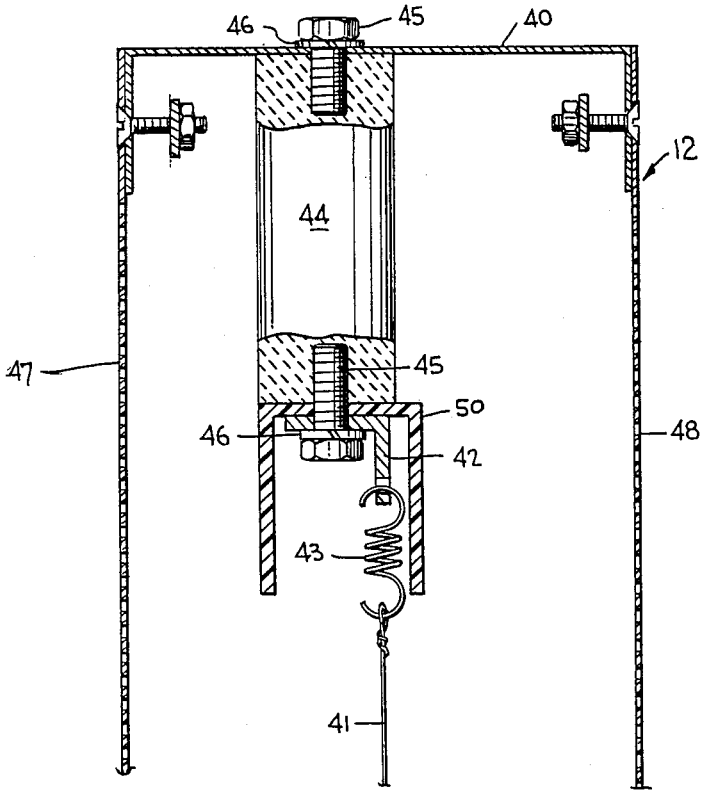
FIG. 11 is a partial detail view in vertical section of the precharger unit of FIG. 10.
Figure 12:
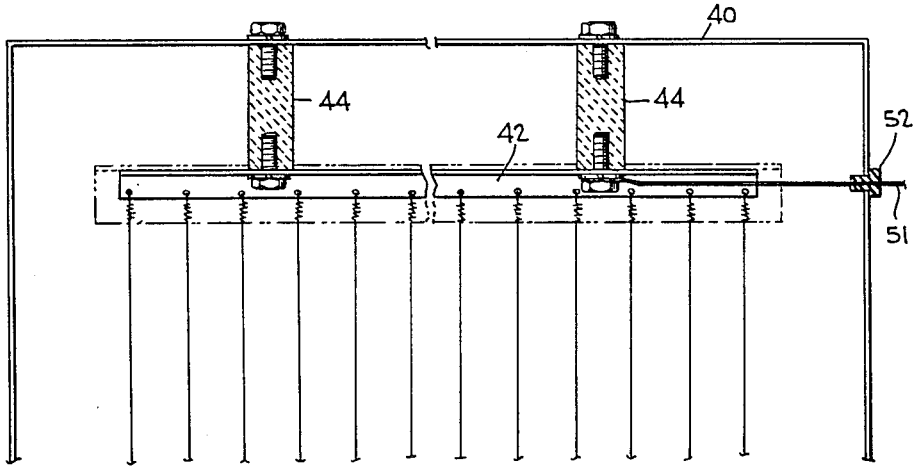
FIG. 12 is a partial front view in elevation of the precharger unit of FIG. 10.

Referring to FIGS. 10–12 of the accompanying drawings, the precharger 12 includes a metal rectangular frame 40. A plurality of high voltage or corona wires 41, preferably made of tungsten, are spaced between one and two inches apart and extend in parallel relation across the flow path through frame 40 at a location which is approximately the center of the depth dimension (i.e., the dimension between the upstream and downstream ends) of the frame. In the preferred embodiment the wires 41 are between 0.005 inch and 0.008 inch in diameter. The high voltage wires 41 are suspended between respective electrically conductive angle beams 42 by means of individual springs 43. A pair of ceramic insulators 44 are disposed on each side frame 40 and have one end secured to the frame by means of a screw 45 and lock washer 46. The ceramic insulators 44 extend into the flow path a distance of approximately two inches, sufficient to prevent sparking between the frame 40 and the angle beam 42 supported at the other end of the insulators. Similar screws 45 and lock washers 46 are employed to secure the angle beam 42 to the inward end of the insulators 44. The angle beam 42 projects a short distance into the flow path and is perforated to receive the coiled tension springs 43 at the various spaced locations corresponding to the locations of the high voltage wires 41. Perforated ground plates 47 and 48 cover the upstream and downstream ends, respectively, of the housing 40 for the precharger and permit air flow through the housing. Perforated plates 47 and 48 are grounded by virtue of their connection directly to the frame 40. With this construction, it is relatively easy to achieve an equal spacing relationship (i.e., equispacing) between each wire 41 and the two grounded plates 47 and 48. This is because only two grounded plates are employed and further higher gaps between the wires and plates can be utilized. Higher gap values mean that misalignment of the plates becomes a smaller fraction of the total gap, thereby resulting in an effective elimination of local sparking.

Since the angle bar 42 and springs 43 have larger dimensions/diameters than the individual wires 41, the angle bars and springs are closer to the perforated ground electrodes than are the wires. This can be a cause for a non-uniform field. If this occurs, current may leak through a local point, resulting in a lack of ionization of the particles passing through the precharger with the fluid to be filtered. As a consequence, the effectiveness of the charger would be significantly reduced. In order to circumvent this, the angle bar and spring are shielded by a U-shaped channel member 50 at both ends of the wires 41. The U-shaped channel member has a base portion which is secured to the insulators 44 along with the angle bar 42 by screws 45 and lock washers 46. In addition, the plastic U-shaped insulating guard includes two arm members extending toward the flow path a sufficient distance to cover the angle bar 42 and springs 43. The plastic guard 50 thereby prevents a direct arcing path between the angle bar 42 or springs 43 and either of the grounded plate members 47.

Figure 13:
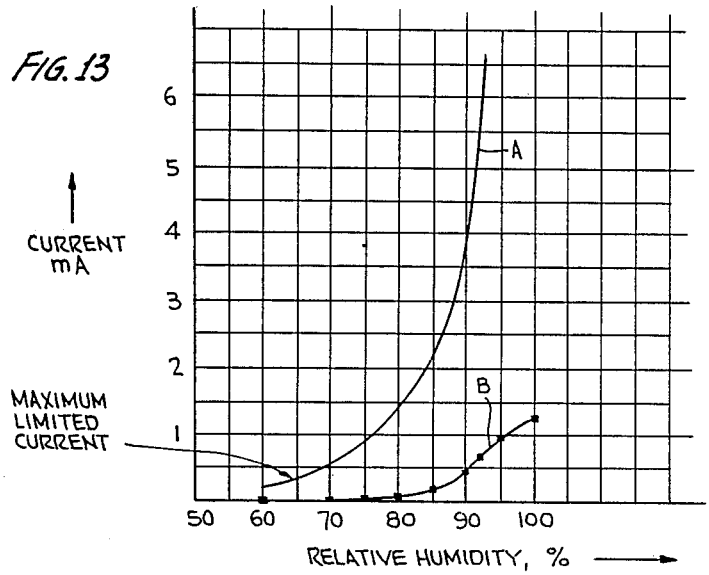
FIG. 13 is a plot of current as a function of relative humidity for a prior art electrically stimulated filter and for the electrically stimulated filter of the present invention.

As noted above, the efficiency of prior art electrically stimulated filter units drops markedly with increases in the relative humidity of the filtered medium. The present invention overcomes this problem by separating the electrodes in filter 11 from the filter material 26 by means of air gaps 31 and 32. These air gaps make the current draw of the electrically stimulated filter of the present invention increase only marginally for relative humidities up to 100%. The effectiveness of the invention, in this regard, is illustrated in FIG. 13 wherein curve A represents the current versus humidity characteristic for the filter disclosed in the Masuda, et al., U.S. Pat. No. 4,509,958 referred to above and curve B represents the same parameter for the electrically stimulated filter of the present invention. For the devices tested, the areas of the two filters were equal. It is clear that the current drawn by the present invention (i.e., curve B), in response to increasing relative humidity is significantly lower than that for the Masuda, et al., filter. In general, apart from the contacting or non-contacting electrode design aspect of a filter, the current draw also depends on field strength. In the test which resulted in the plots of FIG. 13, the Masuda, et al., filter (curve A) was run at an estimated two KV/cm average field strength (which was not uniform) while the device of the present invention was run at 1.6 KV/cm field strength. Thus, although there is a difference in field strength, it is not enough to explain the differences in current draw as represented in FIG. 13. This difference is due to the electrodes in the Masuda, et al., filter having contact with the filter medium wheres the air gaps 31, 32 of the present invention prevent this contact. It should also be noted that in Masuda, et al., *one* of the electrodes is covered by an electrically insulated film to reduce sparking. Obviously, from curve A in FIG. 13, this was not enough to reduce the current draw nearly as effectively as the air gap of the present invention. It should further be noted that, in the present invention, both the high potential and ground electrodes are separated from the filter medium 26 by respective air gaps.

Figure 14:
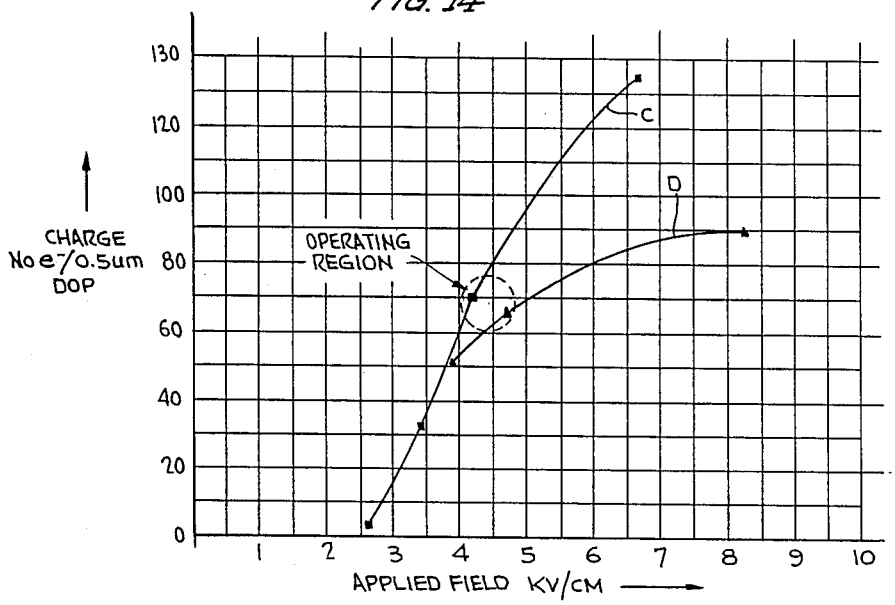
FIG. 14 is a plot of charge versus applied voltage for the prior art electrically stimulated filter and the electrically stimulated filter of the present invention.

With respect to the precharger 12, field uniformity is readily achieved by means of the present invention. It is this field uniformity that provides the precharger with a significant performance improvement over the precharger disclosed in the aforementioned Masuda, et al., patents. This performance improvement is illustrated in the charge versus applied field plot of FIG. 14 wherein said curve C is a plot for the present invention and curve D is a plot for the Masuda, et al., precharger. In the Masuda, et al., precharger, if the gap between wires and plates is increased, the number of wires possible in a given size decreases and, therefore, the level of the charging decreases. Further, due to the simplicity of utilizing only two ground electrodes in the present invention, the present invention is significantly less expensive to fabricate.

It should also be noted that the springs 43 play a significant part in the present invention by maintaining the wires 41 taut and thereby preventing vibration in response to the flow of the fluid medium being filtered.

Only one of the angle bars 42 requires connection to the high voltage cable 51 in the precharger 12 since the entire assembly, including both angle bars and the wires 41 and springs 43 are floating at the high voltage delivered by cable 51. The cable is provided through an entry point using an insulator connector 52 at a suitable opening in housing 40. The wire is connected to the angle bar at the nearest location on the angle bar at which a screw 45 secures the angle bar to an insulator 44.

In the preferred embodiment of the precharger, the wires 41 are spaced one inch apart, the insulators 44 are one inch long, the angle bar 42 is one-eighth inch thick and has legs one half inch long, the wires 41 are spaced one and $\frac{3}{8}$ (three/eighth) inches from each of the grounded plates 47, 48, the ends of the angle bars 42 are spaced one and seven-eighth inch from the sides of frame 40, the angle bar is twenty and one-quarter inches long, and the end wires 41 are two inches from the sides of the frame 40. The plastic guard strips 50 extend lengthwise beyond the ends of the angle bars 42 and have a depth sufficient to include the springs 43 and angle bars 42 within the guard channel. In general, any exposed electrically hot (i.e., high voltage) parts, such as the springs 43, angle irons 42, etc. are kept at least one and one half inches apart from any grounded surface or else are shielded by the guard 50. Only the wires 41 are directly exposed to the grounded plates 47 and 48 and are one and a half inches spaced from those plates.

The plates 47 and 48 are permanently welded to lips on the metal frame 40.

The invention as described herein is an improved electrically stimulated filter and precharger for removing suspended particles from a fluid stream. While the invention has been particularly shown and described with reference to a preferred embodiment thereof, it will be understood by those skilled in the art that various changes in the form and detail may be made without departing from the spirit and scope of the invention.

I claim:

1. An electrically stimulated filter assembly for separating suspended particles from a flowing fluid stream comprising:

a filter housing having an upstream end for admitting said fluid stream into said filter housing, a downstream end for discharging said fluid stream from said filter housing, and a filter flow path through said filter housing from said upstream end to said downstream end;

an electrically non-conductive filter means disposed in said filter flow path such that substantially said entire fluid stream passes through said filter means;

a first and a second electrode which are perforated plates disposed in said filter housing at the upstream and downstream sides, respectively, of said filter means;

a first insulative spacer means for establishing a first air gap preventing physical contact between said first electrode means and said filter means; and a second insulative means for establishing a second air gap preventing physical contact between said second electrode means and said filter means;

said filter housing including a frame of electrically conductive material, wherein said first electrode means is disposed proximate said upstream end in electrically conductive relation to said frame, and wherein said second electrode means is disposed proximate said downstream end, said assembly further comprising mounting means for securing said second electrode means to said frame in electrically insulated relation to said frame;

said frame includes a lip at said downstream end to define a downstream outlet having predetermined length and width dimensions, said lip having upstream and downstream facing surfaces;

wherein said second electrode means which is a perforated plate has length and width dimensions which are smaller than said predetermined length and width dimensions, respectively;

said mounting means comprising first and second elongated support members of insulative material having a length slightly greater than said predetermined width but smaller than the width of said frame, said support members having a thickness dimension defined between upstream-facing and downstream-facing sides of said support members, said upstream-facing side being secured to said second perforated plate, said downstream-facing side being secured to said upstream-facing surface of said lip to extend width-wise across said downstream outlet;

whereby said second perforated plate is supported within said frame spaced from said downstream outlet by the thickness of said support members; and whereby filtering efficiency is not significantly affected by increase in humidity in said fluid stream due to the presence of said air gap.

2. The electrically stimulated filter assembly according to claim 1 wherein said first spacer means comprises at least a first electrically non-conductive spacer member disposed in said filter flow path between said first perforated plate and said filter means, said first spacer member having a cross-sectional area transverse to said filter flow path which is a small fraction of the area of the filter flow path, and wherein said second spacer means comprises at least a second electrically non-conductive spacer member disposed in said filter flow path between said second perforated plate and said filter means, said first spacer member having a cross-sectional area transverse to said filter flow path which is a small fraction of the area of the filter flow path.

3. The electrically stimulated filter according to claim 1 wherein said lip at said downstream end projects radially inward and generally perpendicular to said filter flow path.

4. The electrically stimulated filter according to claim 1 wherein said support members are respective hollow plastic tubes.

5. The electrically stimulated filter according to claim 1 wherein said filter means includes a sheet-like member of filter material arranged in a series of multiple accordion pleats having fold lines oriented along the length dimension of said downstream outlet and defining multiple troughs and peaks;

wherein said first spacer means comprises a first plurality of electrically insulative comb-like members having a base portion secured to said first perforated plate and a plurality of spaced teeth extending from said base member and into respective troughs of said filter means to maintain said pleats in an open state; and wherein said second spacer means comprises a second plurality of electrically insulative comb-like members having a base portion secured to said second perforated plate and a plurality of spaced teeth extending from that base portion and into respective troughs in said filter means to maintain the pleats in an open state.

6. The electrically stimulated filter assembly according to claim 1 wherein said filter means includes a sheet-like member of filter material arranged in a series of multiple accordion pleats having fold lines oriented along the length dimension of said downstream outlet and defining multiple troughs and peaks;

wherein said first spacer means comprises a first plurality of electrically insulative comb-like members having a base portion secured to said first perforated plate and a plurality of spaced teeth extending from said base member and into respective troughs of said filter means to maintain said pleats in an open state; and wherein said second spacer means comprises a second plurality of electrically insulative comb-like members having a base portion secured to said second perforated plate and a plurality of spaced teeth extending from that base portion and into respective troughs in said filter means to maintain the pleats in an open state.

7. The electrically stimulated filter according to claim 1 further comprising:

an assembly housing, said filter housing being disposed in said assembly housing, said assembly housing having an inlet end for receiving said fluid stream and an outlet end for discharging said fluid stream from said assembly housing; and precharger means disposed in said assembly housing upstream of said filter housing for electrically charging said suspended charged particles prior to their entry with the fluid stream into said filter housing.

8. The electrically stimulated filter assembly according to claim 7 wherein said precharger means comprises:

a precharger housing defining a framed flow passage and having open front and back ends, said precharger housing being oriented in said assembly housing to permit flow of said fluid stream through said framed flow passage from the front end to the back end;

a plurality of electrically conductive wires;

said precharger housing includes an outer frame and front and back perforated metal screen members disposed over said front and back ends, respectively, in contact with said outer frame;

suspension means for suspending each of said wires across said framed flow passage in mutually spaced parallel relation and electrically insulated from said screen members; and electrical connector means for applying a high voltage between each of said suspended wires and said screen members.

9. The electrically stimulated filter assembly according to claim 8 wherein said precharger housing is metal and wherein said suspension means comprises:

first and second electrical insulator means secured to said metal precharger housing at first and second locations, respectively, on opposite sides of said flow passage, each insulator means having a first end secured adjacent said precharger housing and a second end extending transversely into said flow passage;

first and second electrically conductive terminal means secured to the second end of said first and second insulator means, respectively; and further means suspending each of said wires between said first and second electrically conductive terminal means and across said flow passage.

10. The electrical filter assembly according to claim 9 wherein:

said precharger means further comprises first and second plastic generally U-shaped channels having a base portion secured to said second end of said first and second electrical insulator means, respectively, and having first and second leg portions extending toward said flow passage in front of and in back of said further means.

11. The electrically stimulated filter assembly according to claim 9 wherein said first electrically conductive terminal means comprises a first elongated metal bracket member;

wherein said further means comprises a first plurality of individual spring members, one for each of said wires, secured to said first bracket member at spaced locations along the length of said first bracket member;

wherein said second electrically conductive terminal means comprises a second elongated metal bracket member;

wherein said further means further comprises a second plurality of individual spring members, one for each of said wires, secured to said second bracket member at spaced locations along the length of said second bracket member; and wherein each of said wires is tautly suspended across said flow passage between respective spring members in said first and second plurality of individual spring members.

12. The electrically stimulated filter assembly according to claim 11 further comprising insulative shield means disposed between said spring members and said precharger housing for preventing electrical arcing between said spring members and said precharger housing.

13. The electrically stimulated filter assembly according to claim 12 wherein said insulative shield means comprises first and second plastic generally U-shaped channels having a base portion secured to said second end of said first and second electrical insulator means, respectively, and having first and second leg portions extending toward said flow passage in front of and in back of said spring members.

14. An electrically stimulated filter assembly for separating suspended particles from a flowing fluid stream, comprising:

a filter housing having an upstream end for admitting said fluid stream into said filter housing, a downstream end for discharging said fluid stream from said filter housing from said upstream end to said downstream end, said filter housing being of an electrically conductive metal material;

an electrically non-conductive filter means disposed in said filter flow path such that substantially said entire fluid stream passes through said filter means;

a first and second electrode means disposed in said filter housing on opposite sides of said filter means, said first electrode means being disposed proximate said upstream end, said second electrode means being disposed proximate said downstream end;

a first terminal means for applying a ground potential to said first electrode means and to said filter housing;

a second terminal means for applying a high voltage relative to ground to said second electrode means; and said first and second electrode means being first and second perforated plates, respectively, disposed in said filter flow path to permit said fluid stream to flow through said perforated plates;

said filter means being a sheet-like member of filter material arranged in a series of multiple accordion pleats having fold lines oriented along the length dimension of said downstream end and defining multiple troughs and peaks;

a first insulative spacer means for establishing a first air gap preventing physical contact between said first electrode means and said filter means; and a second insulative spacer means for establishing second air gap preventing physical contact between said second electrode means and said filter means;

wherein said second spacer means comprises a comb member having a base portion secured to said second perforated plate and also having a plurality of teeth extending from said base member into respective troughs in said filter means to maintain said pleats in an open state;

whereby filtering efficiency is not significantly affected by increases in humidity in said fluid stream due to the presence of said air gap.

15. In an electrically stimulated filter assembly for separating suspended charged particles from a flowing fluid stream, a precharger for electrically charging the suspended particles, said precharger comprising in combination:

a metal precharger housing having a framed flow passage and having front and back ends, said precharger housing being oriented to permit flow in a predetermined direction of said fluid stream through said framed flow passage from said front end to said back end;

a plurality of electrically conductive wires;

a suspension means for suspending each of said wires across said framed flow passage in mutually parallel relation, said suspension means being electrically insulated from said metal precharger housing;

a means for applying a high voltage disposed between each of said suspended wires and said metal precharger housing;

a first ground plate adjacent said front end of said precharger housing disposed generally perpendicularly to said predetermined direction; said first ground plate being perforated such that particles in the fluid stream pass therethrough;

a second ground place adjacent said back end of said precharger housing disposed generally perpendicularly to said predetermined direction; said second ground plate being perforated such that particles in the fluid stream pass therethrough;

said suspension means comprising first and second electrical insulator means secured to said metal precharger housing at first and second locations, respectively, on opposite sides of said flow passage, each insulator means having a first and secured adjacent said precharger housing and a second end extending transversely into said flow passage;

first and second electrically conductive terminal means secured to the second end of said first and second insulator means, respectively;

a further means suspending each of said wires between said first and second electrically conductive terminal means and across said flow passage;

said first electrically conductive terminal means comprising a first elongated metal bracket member;

wherein said further means comprises a first plurality of individual spring members, one for each of said wires, secured to said first bracket member at spaced locations along the length of said first bracket member;

said second electrically conductive terminal means comprising a second elongated metal bracket member;

said further means further comprising a second plurality of individual spring members, one for each of said wires, secured to said bracket member at spaced locations along the length of said second bracket member;

each of said wires being tautly suspended across said flow passage between respective spring members in said first and second plurality of individual spring members;

said precharger housing including an outer frame and front and back perforated metal screen members disposed over said front and back end, respectively, in electrically conductive contact with said outer frame;

said precharger further comprising insulative shield means disposed between said spring members and said screen members;

whereby due to passage of particles through said perforations in said first and second ground plates, the particles are exposed to maximum ionization flux on leading and trailing sides thereof.

16. In an electrically stimulated filter according to claim 15 wherein said insulative shield means comprises first and second plastic generally U-shaped channels having a base portion secured to said second end of said first and second electrical insulator means, respectively, and having first and second leg portions extending toward said flow passage in front of and in back of said spring members.

17. An electrically stimulated filter assembly for separating suspended particles from a flowing fluid stream, comprising:

a fluid filter housing having an upstream end for admitting said fluid stream into said filter housing, a downstream end for discharging said fluid stream from said filter housing, and a filter flow path through said filter housing from said upstream end to said downstream end;

an electrically non-conductive filter means disposed across said filter flow path such that substantially said entire fluid stream passes through said filter means, said filter means being fixedly secured to portions of said filter housing;

oppositely charged first and second electrode means disposed transversely in said filter housing at the upstream and downstream ends, each of said first and second electrode means being in the form of a plate having a multiplicity of openings therethrough to permit said fluid stream to pass through said electrode means;

insulative means for establishing a first air gap space of approximately one-eighth inch between said first electrode means and said filter means; and insulative means for establishing a second air gap space of approximately one-eighth inch between said second electrode means and said filter means;

whereby filtering efficiency is not significantly affected by increases in humidity in said fluid stream due to the presence of said first and second air gaps.

18. The electrically stimulated filter assembly according to claim 17 wherein said means for establishing said first air gap comprises at least a first electrically insulative spacer member disposed in said filter flow path between said first electrode means and said filter means, said first spacer member having a cross-sectional area transverse to said filter flow path which is a small fraction of the area of the filter flow path, and wherein said means for establishing said second air gap comprises at least a second electrically insulative spacer member disposed in said filter flow path between said second electrode means and said filter means, said second spacer member having a cross-sectional area transverse to said filter flow path which is a small fraction of the area of the filter flow path.

19. The electrically stimulated filter assembly according to claim 17 wherein said filter housing includes a frame, wherein said first electrode means is disposed proximate said upstream end in electrically conductive relation to electrical ground, and wherein said second electrode means is disposed proximate said downstream end, said assembly further comprising mounting means for securing said second electrode means to said frame in electrically insulated relation to said first electrode means.

20. The electrically stimulated filter assembly according to claim 19 wherein said frame is formed of electrically conductive material;

said first electrode means being in electrically conductive relation to said frame;

said downstream end of said filter housing having an opening of predetermined length and width dimensions;

wherein said second electrode means has length and width dimensions smaller than said predetermined length and width dimensions, respectively; and wherein said mounting means comprises at least one electrically non-conductive support member secured to said frame and to said second electrode means for supporting said second electrode means in space relation to said frame.

21. The electrically stimulated filter according to claim 18 wherein said filter means includes a sheet-like member of filter material arranged in a series of multiple accordion pleats having a fold line oriented along the length dimension of said downstream outlet and defining multiple troughs and peaks, edge portions of said sheet-like member being fixedly secured to said portions of said filter housing;

wherein said first spacer, member comprises a first plurality of electrically insulative comb-like members having a base portion secured to said first electrode means and a plurality of spaced teeth extending from said base member and into respective troughs of said filter means to maintain said pleats in an open state;

wherein said second spacer member comprises a second plurality of electrically insulative comb-like members having a base portion secured to said second electrode means and a plurality of spaced teeth extending from that base portion and into respective troughs in said filter means to maintain the pleats in an open state; and wherein the teeth of said first and second spacer members are tapered from root ends thereof to tip ends thereof whereby the pleats of said filter means can be inserted only to a limited depth between the teeth of said first and second spacer members, for establishing the length of said first and second air gaps.

22. The electrically stimulated filter according to claim 17 further comprising:

an assembly housing, said filter housing being disposed in said assembly housing, said assembly housing having an inlet end for receiving said fluid stream and an outlet end for discharging said fluid stream from said assembly housing; and precharger means disposed in said assembly housing upstream of said filter housing for electrically charging said suspended charged particles prior to their entry with the fluid stream into said filter housing.

23. In an electrically stimulated filter assembly for separating suspended charged particles from a flowing fluid stream, a precharger for electrically charging the suspended particles, said precharger comprising in combination:

a precharger housing having a framed flow passage and having front and back ends, said precharger housing being oriented to permit flow in a predetermined direction of said fluid stream through said framed flow passage from said front end to said back end;

a first ground plate adjacent said front end of said precharger housing disposed generally perpendicularly to said predetermined direction; said first ground plate being perforated such that particles in the fluid stream pass therethrough;

a second ground plate adjacent said back end of said precharger housing disposed generally perpendicularly to said predetermined direction; said second ground plate being perforated such that particles in the fluid stream pass therethrough;

a plurality of electrically conductive wires;

a suspension means for suspending each of said wires across said framed flow passage in mutually parallel relation, said suspension means being electrically insulated from said ground plates;

a means for applying a high voltage disposed between each of said suspended wires and said ground plates;

said suspension means comprising first and second electrical insulator means secured to said precharger housing at first and second locations, respectively, on opposite sides of said flow passage, each insulator means having a first end secured adjacent said precharger housing and a second end extending transversely into said flow passage;

first and second electrically conductive terminal means secured to the second end of said first and second insulator means, respectively;

a further means suspending each of said wires between said first and second electrically conductive terminal means and across said flow passage;

said first electrically conductive terminal means comprising a first elongated metal bracket member;

wherein said further means comprises a first plurality of individual spring members, one for each of said wires, secured to said first bracket member at spaced locations along the length of said first bracket member;

said second electrically conductive terminal means comprising a second elongated metal bracket member;

said further means further comprising a second plurality of individual spring members, one for each of said wires, secured to said bracket member at spaced locations along the length of said second bracket member;

each of said wires being tautly suspended across said flow passage between respective spring members in said first and second plurality of individual spring members;

said precharger further comprising insulative shield means disposed between said spring members and said ground plates;

whereby due to passage of particles through said perforations in said first and second ground plates, the particles are exposed to maximum ionization flux on leading and trailing sides thereof.

24. In an electrically stimulated filter according to claim 23, said precharger housing being metal.

* * * * *